US009284695B2

(12) United States Patent
Dulieu

(10) Patent No.: US 9,284,695 B2
(45) Date of Patent: Mar. 15, 2016

(54) PROTECTIVE PAD ASSEMBLY FOR USE WITH MOTORIZED COMPACTOR

(71) Applicant: Paul David Dulieu, Honeoye Falls, NY (US)

(72) Inventor: Paul David Dulieu, Honeoye Falls, NY (US)

( * ) Notice: Subject to any disclaimer, the term of this patent is extended or adjusted under 35 U.S.C. 154(b) by 0 days.

(21) Appl. No.: 14/277,519

(22) Filed: May 14, 2014

(65) Prior Publication Data

US 2015/0330036 A1 Nov. 19, 2015

(51) Int. Cl.
*E01C 19/34* (2006.01)
*E01C 19/22* (2006.01)
*E01C 19/30* (2006.01)

(52) U.S. Cl.
CPC ..... *E01C 19/22* (2013.01); *E01C 19/30* (2013.01); *E01C 19/34* (2013.01)

(58) Field of Classification Search
CPC ..... E01C 19/30; E01C 19/32; E01C 19/34
USPC ..... 404/133.05, 133.1, 133.2; 104/10
See application file for complete search history.

(56) References Cited

U.S. PATENT DOCUMENTS

| | | | | |
|---|---|---|---|---|
| 3,091,159 | A * | 5/1963 | Miller | 404/133.2 |
| 6,394,697 | B1 * | 5/2002 | De Boer | 404/133.1 |
| 6,925,940 | B2 * | 8/2005 | Ruban | 104/10 |
| 7,013,812 | B2 * | 3/2006 | Williams | 104/10 |
| 7,387,466 | B2 * | 6/2008 | Irwin | 404/133.1 |
| 7,740,416 | B2 * | 6/2010 | Lesche | 404/133.1 |
| 2002/0051682 | A1 * | 5/2002 | Gevik et al. | 404/133.05 |
| 2011/0013982 | A1 * | 1/2011 | Prohaska | 404/72 |

* cited by examiner

*Primary Examiner* — Gary Hartmann
(74) *Attorney, Agent, or Firm* — Keith A. Vogt; Vogt IP

(57) ABSTRACT

A pad for use with a compactor having a planar plate for protecting material to be protected. The pad includes a rigid planar surface adapted to maintain a co-planar relationship with the plate of the compactor during the operation of the compactor. The pad is adapted to be affixed to the compactor by clamps and other mechanical devices.

7 Claims, 4 Drawing Sheets

PROTECTIVE PAD ASSEMBLY FOR USE WITH MOTORIZED COMPACTOR

CROSS-REFERENCE TO RELATED APPLICATIONS

Not Applicable.

STATEMENT REGARDING FEDERALLY SPONSORED RESEARCH OR DEVELOPMENT

Not Applicable.

INCORPORATION-BY-REFERENCE OF MATERIAL SUBMITTED ON A COMPACT DISC

Not Applicable.

BACKGROUND OF THE INVENTION

Field of the Invention

The present invention concerns a protective pad that prevents damage to material that is subjected to compaction such as paver bricks. In particular, paver brick and other materials laid over a sand base often require compacting as part of the installation process. Current paver designs often include uneven top surfaces having peaks and valleys that mimic the contours of natural stone. However, when a motorized compactor having a metal base is passed over a peak, the peak is often marred and/or broken as a result of the compactor concentrating force on the peak. To solve this problem, one approach has been to place a soft pad made from rubber, silicone or urethane over the compactor's compaction plate and to bolt the rubber pad to the compactor.

Using a soft pad has several drawbacks. First, the pad will often rip at one or more mounting points on the compactor. Also, a compactor, which is typically gas powered, typically cannot be pulled in reverse and in other directions as a result of the flexible pad's tendency to bunch. This limits the range of motion of the compactor.

BRIEF SUMMARY OF THE INVENTION

The present invention provides solutions to the above-mentioned limitations of the prior designs. It provides an inflexible, non-metallic pad this resists tearing or ripping at an attachment point. It does not hinder compactor speed of operation or inhibit direction of movement. It is also fast and easy to attach and remove, saving time and effort, unlike soft pads that need to be bolted after drilling holes into the compactor. Moreover, a universal attachment portion is freely positionable to permit mounting to many different compactor designs.

DETAILED DESCRIPTION OF THE INVENTION

Figure 1:
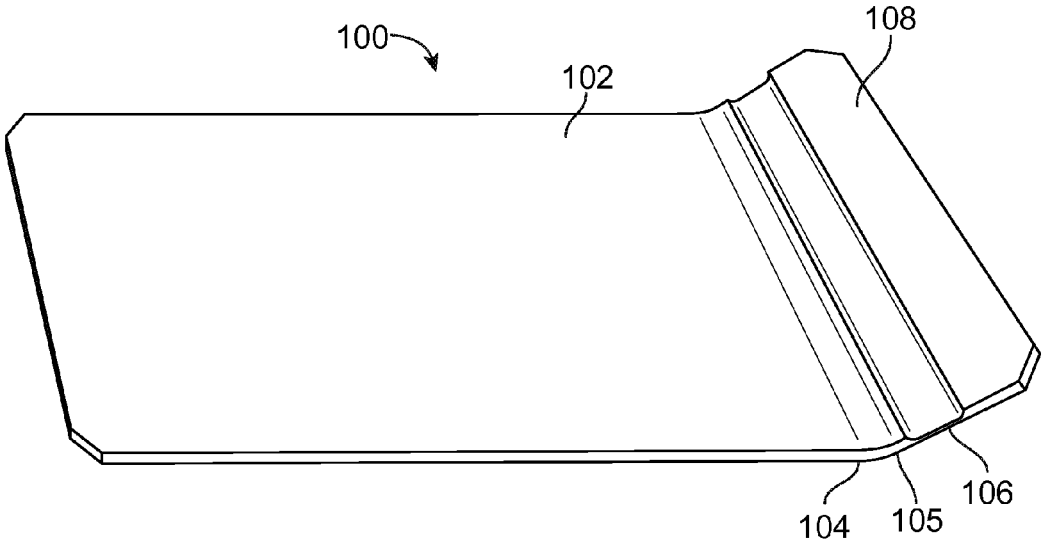
FIG. 1 is a perspective view of an embodiment of the present invention.

This description is not to be taken in a limiting sense, but is made merely for the purpose of illustrating the general principles of the invention. The scope of the invention is defined by the appended claims.

As shown in FIGS. 1 through 4, the present invention includes a pad 100 having an inflexible or rigid planar portion 102 having an upwardly curved lip 104 connected to a hinge member 106 and an attachment portion 108. Rigid planar portion 102 can be any substantially rigid or semi-rigid material, such as, but not limited to, plastic and other non-metallic materials. In one configuration, the planar portion may be made from a substantially sturdy rigid sheet material that has a small deflection when subject to a compacting force or when moved across a surface to be compacted. Suitable materials for pad 102 include, but are not limited to, acrylonitrile-butadiene-styrene, acrylic, chlorinated polyvinyl chloride, nylon, polycarbonate, polyethylene LOPE and HOPE, polypropylene, polyvinyl chloride, and styrene.

Figure 6:
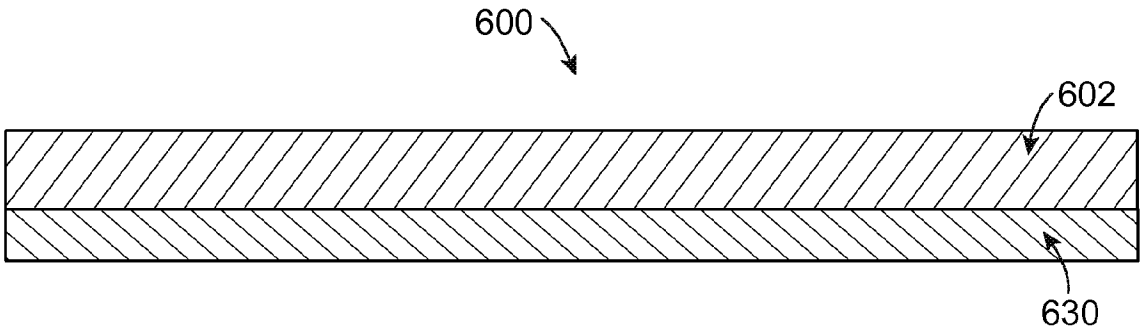
FIG. 6 is a cross-sectional view of another embodiment of the present invention.

In addition, planar portion may also be a composite of rigid material sections 140-142 and a flexible material 150 which may be an elastomeric material. In addition, as shown in FIG. 6, pad 600 may be a layered composite of a rigid material 602 and flexible material 630.

Figure 2A:
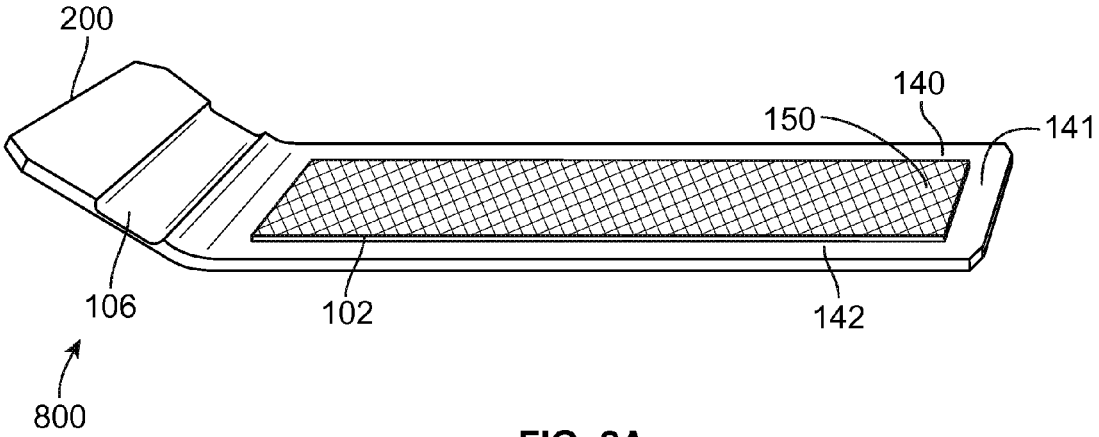
FIG. 2A is a perspective view of another embodiment of the present invention.
Figure 2B:
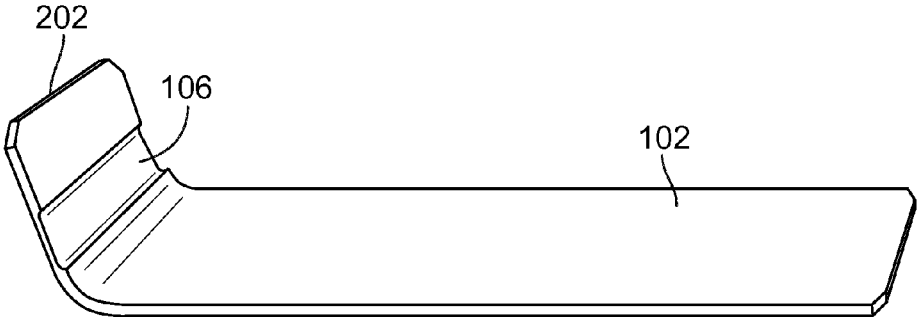
FIG. 2B is a perspective view of yet another embodiment of the present invention.
Figure 3:
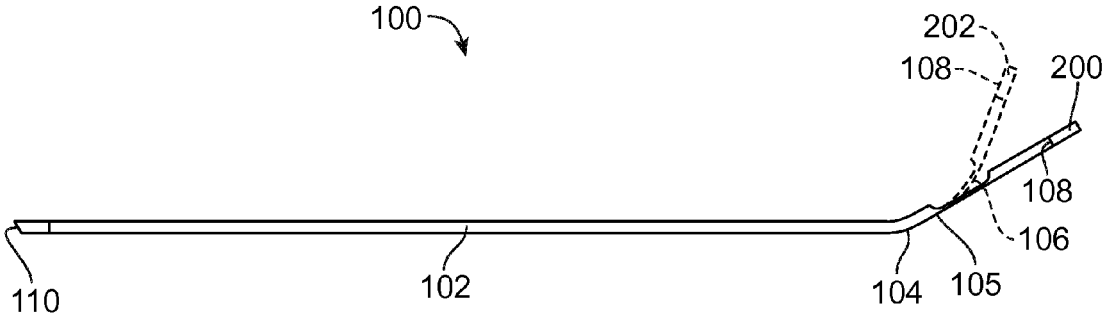
FIG. 3 is a side view showing the universal positioning aspect of the attachment portion.
Figure 7:
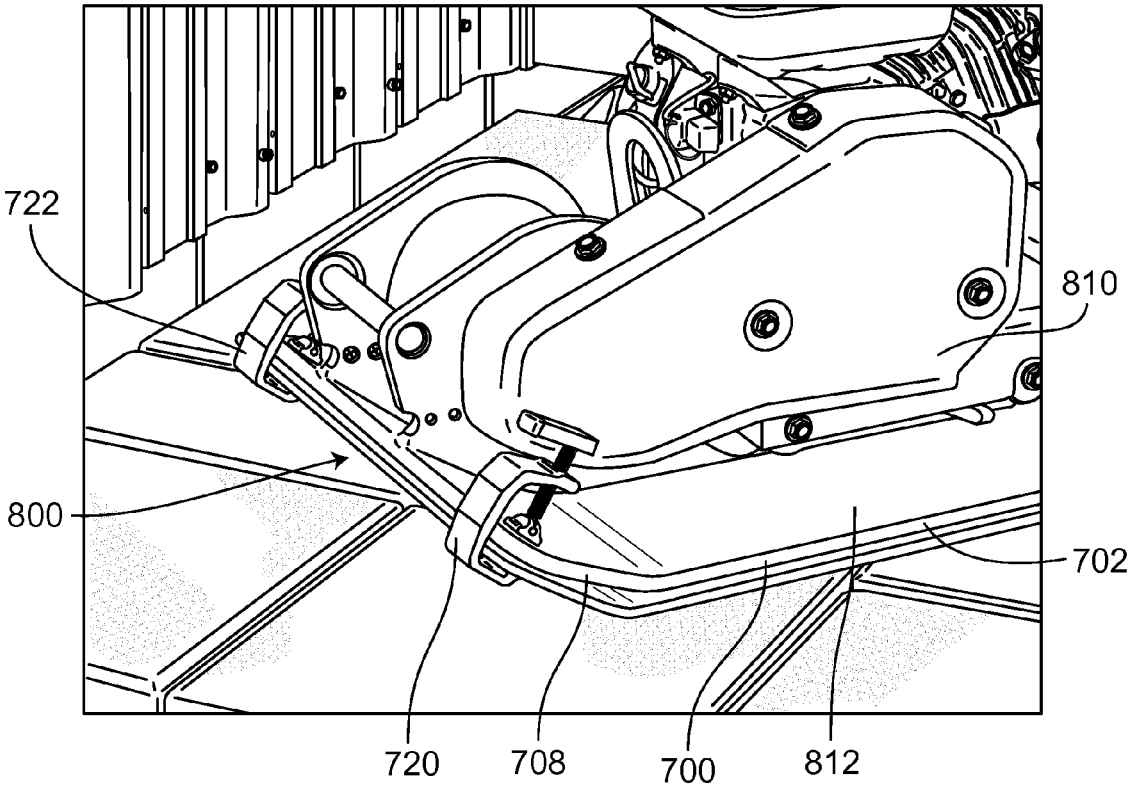
FIG. 7 illustrates an embodiment of the present invention in use.

As shown in FIGS. 2A, 2B and 7, planar portion is adapted to have sufficient rigidity and corresponding limited amount of deflection, or none at all, so as to maintain a co-planar relationship with a surface to be compacted 800 during the compaction process. In addition, the planar portion is also adapted to have sufficient rigidity to maintain a co-planar relationship with planar compaction plate 812 of compactor 810 during the operation of compactor 810. This co-planar relationship is maintained for all directions of travel of compactor 810.

Tapered edge 110 is located opposite tapered edge 105 formed by bend 104. The edges, which oppose one another, allow for the smooth travel of the pad and compactor assembly over a surface that often includes loose material such as sand and the like. The edges may also be beveled, rounded and in other configurations.

Figure 4:
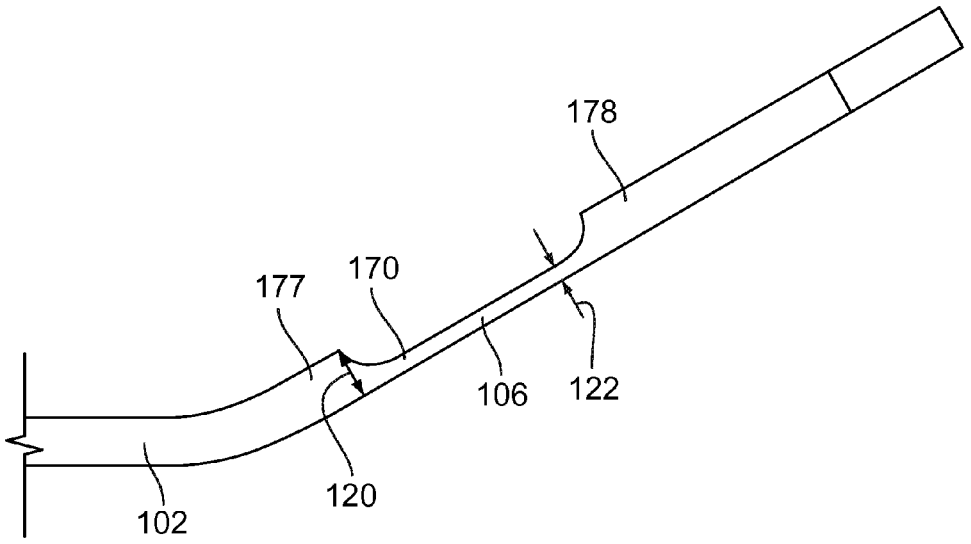
FIG. 4 is an explode side view.

As shown in FIG. 7, pad 700 is attached to compactor 810 by clamps 720 and 722 which clamp attachment portion 708 to the machine. As a result of compactors having different angular front edges, in a preferred embodiment, pad 100 includes a hinged portion 106, which allows attachment portion 108 to be positioned in a variety of angular positions such as 200 and 202. Hinged portion 106 may be a mechanical hinge of a living hinge as shown. As shown in FIG. 4, living hinge 106 is comprised of section 170 that connects sections 177 and 178. To create the flexibility to form the hinge, section 170 may be substantially less in thickness than sections 177 and 178. In a preferred configuration, section 170 is 75 percent thinner than the other sections.

Figure 5:
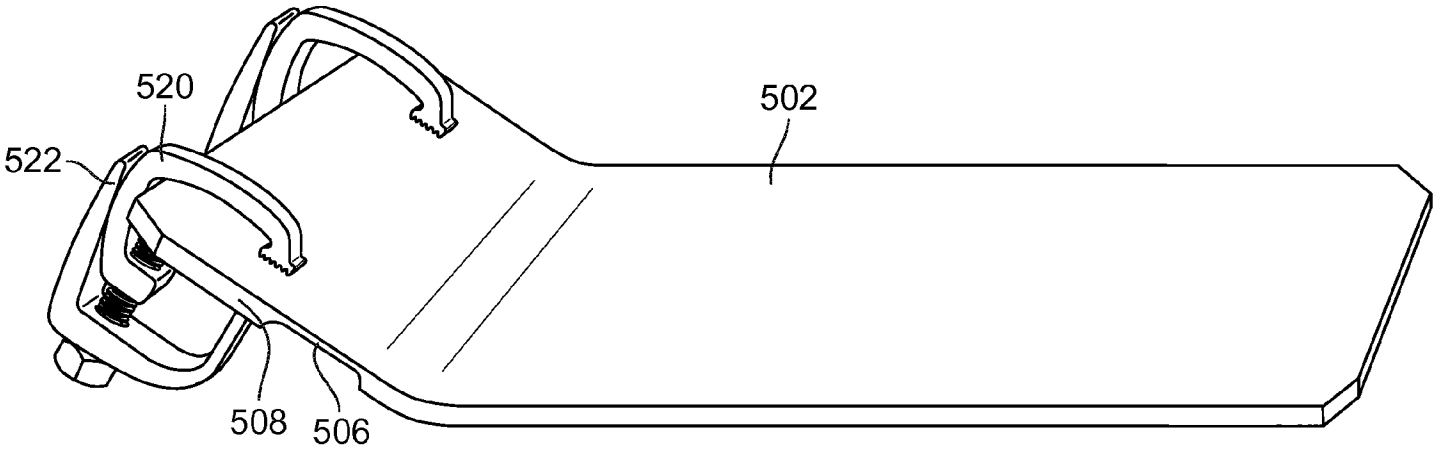
FIG. 5 is a perspective view of another embodiment of the present invention.

In addition, hinge 106 may face the compactor or it may face way from the compactor such as shown in FIG. 5 for hinge 506. Even with the hinge facing away from the compactor, attachment portion 508 may still be affixed to a device by clamps 520 and 522. In addition, a pad may be affixed to a compactor by bolts, screws, fasteners, rivets and in other ways known to those of skill in the art.

Figure 8:
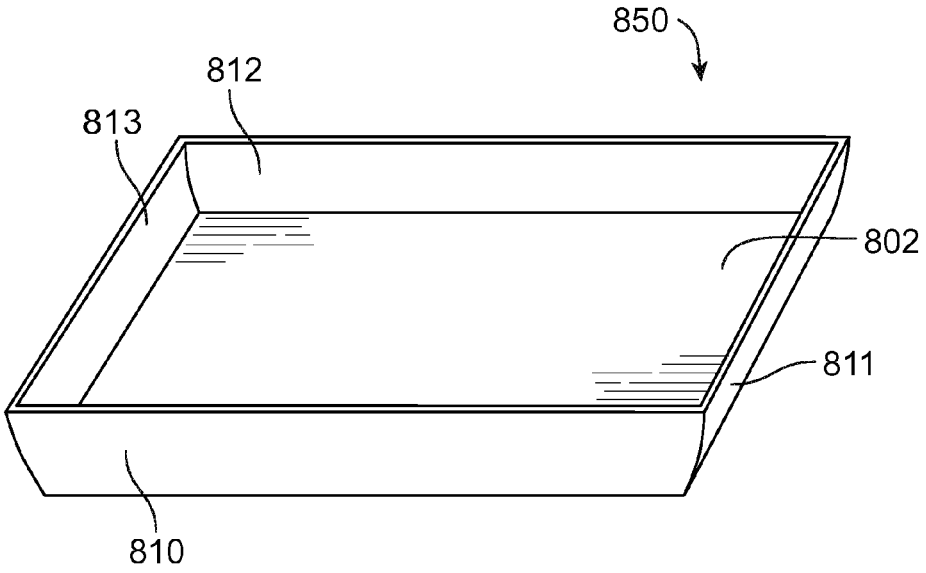
FIG. 8 is a perspective view of another embodiment of the present invention.

FIG. 8 depicts another embodiment, which requires no mechanical affixation of pad 850 to a compactor. In this embodiment, the device is comprised of planar surface 802 which may be of a composition as described above. In addition, pad 802 is connected to sidewalk 810-813 which, together, form a semi-enclosed housing or structure in which a compactor nests or may be placed. The sidewalk maintain the compactor within the device during operation. In addition, the sidewalls may also be angled or tapered to allow for the smooth travel of the pad and compactor assembly over a surface that often includes loose material such as sand and the like. The edges may also be beveled, rounded and in other configurations.

What is claimed is:

1. A pad for use with a compactor having a planar plate comprising:

a rigid planar portion adapted to maintain a co-planar relationship with the plate of the compactor during the operation of the compactor;

an attachment portion connected to said rigid planar portion by a hinge, said attachment portion is positionable between a first position and a second position; and said attachment portion adapted to be affixed to the compactor.

2. The pad of claim 1 wherein said hinge is a living hinge.

3. The pad of claim 1 wherein said hinge faces toward the compactor.

4. The pad of claim 1 wherein said hinge faces away from the compactor.

5. The pad of claim 1 wherein said hinge includes a section with a reduced thickness.

6. The pad of claim 1 wherein said hinge includes a section with a reduced thickness which is 75 percent less thick than said pad.

7. The pad of claim 1 wherein said planar portion includes opposing tapered edges.

* * * * *